US007028473B2

(12) United States Patent
Servis et al.

(10) Patent No.: US 7,028,473 B2
(45) Date of Patent: Apr. 18, 2006

(54) HOT-GAS ENGINE

(76) Inventors: Wilhelm Servis, Gutstrasse 51, CH-8400 Winterthur (CH); Ludwig K. Von Segesser, Avenue du Tribunal Federal 21, Ch-1005 Lausanne (CH)

( * ) Notice: Subject to any disclaimer, the term of this patent is extended or adjusted under 35 U.S.C. 154(b) by 0 days.

(21) Appl. No.: 10/499,110

(22) PCT Filed: Dec. 27, 2002

(86) PCT No.: PCT/CH02/00727

§ 371 (c)(1),
(2), (4) Date: Jul. 28, 2004

(87) PCT Pub. No.: WO03/060309

PCT Pub. Date: Jul. 24, 2003

(65) Prior Publication Data

US 2005/0072149 A1 Apr. 7, 2005

(30) Foreign Application Priority Data

Dec. 31, 2001 (CH) ..... 2382/01
Mar. 6, 2002 (CH) ..... 387/02
Aug. 21, 2002 (CH) ..... 1432/02

(51) Int. Cl.
*F01B 29/10* (2006.01)

(52) U.S. Cl. ..... 60/517; 60/524

(58) Field of Classification Search ..... 60/517, 60/520, 521, 522, 524, 526
See application file for complete search history.

(56) References Cited

U.S. PATENT DOCUMENTS 3,078,683 A * 2/1963 Dros ..... 62/6
3,292,501 A * 12/1966 Verbeek ..... 92/144
3,550,371 A * 12/1970 Jaspers ..... 60/521
3,604,821 A * 9/1971 Martini ..... 417/379
3,788,088 A * 1/1974 Dehne ..... 62/6

(Continued)

FOREIGN PATENT DOCUMENTS

JP 56-124652 9/1981

(Continued)

OTHER PUBLICATIONS

Graham Walker: "The Stirling Alternative" 1994, Gordon and Breach Science Publishers, Great Britain XP002232034 020943 p. 131-p. 136 p. 135, paragraph 2.

*Primary Examiner*—Hoang Nguyen
(74) *Attorney, Agent, or Firm*—Jordan and Hamburg LLP

(57) ABSTRACT

The hot-gas engine comprises a cylinder, a working piston which together with a cylinder cover delimits a cylinder space designed to accommodate a working medium, a displacement piston which divides the cylinder space into a first and a second working space, as well as a heating device for heating device for heating up the working medium contained in the first working space, and a cooling device for cooling the heated working medium. The working spaces are connected so as to be communicating by way of a regenerator arranged in the displacement piston. The heating device comprises a heating area on the end wall of the working piston, and a heating arrangement associated with the working piston. The cooling device comprises an injection device for feeding liquefied working medium into the first working space. This design provides improved heat supply to the working medium contained in the cylinder, and further provides direct cooling of said working medium. At the same time, a simpler and compact construction of the hot-gas engine can be achieved.

16 Claims, 4 Drawing Sheets

U.S. PATENT DOCUMENTS

| | | | | |
|---|---|---|---|---|
| 3,971,230 | A | 7/1976 | Fletcher et al. | |
| 5,647,217 | A * | 7/1997 | Penswick et al. | 62/6 |

FOREIGN PATENT DOCUMENTS

| | | |
|---|---|---|
| JP | 59-007757 | 1/1984 |
| JP | 60-026148 | 2/1985 |
| JP | 61-152949 | 7/1986 |
| JP | 61-152950 | 7/1986 |
| JP | 61-152952 | 7/1986 |

* cited by examiner

HOT-GAS ENGINE

BACKGROUND OF THE INVENTION

The invention relates to a hot-gas engine.

A hot-gas engine of the type mentioned is known from DE 25 22 711 A1. The known engine, a Stirling cycle engine, comprises a cylinder in which a working piston, which is connected to a crank drive, is arranged so as to move to and fro in relation to a displacement piston, which is connected to the same drive. The displacement piston divides the cylinder space into a first working space, delimited by the cylinder cover, and a second working space, delimited by the working piston. The working spaces are connected to an external connection channel by way of a passage each which is provided in the cylinder wall, with said external connection channel comprising a heating device for heating up the working medium in the first working space, and a cooling device for cooling the working medium in the second working space, as well as a regenerator which is arranged between the heating device and the cooling device.

In order to obtain optimal yield of the heat conveyed, expressed in terms of thermal efficiency, generally speaking one tends to try to achieve as large a difference as possible between the temperatures of the working medium in the hot first working space and in the cold second working space. There is a disadvantage in that, in conventional hot-gas engines of the type mentioned, corresponding temperature differences occur also within the cylinder wall and within the walls of the heat-transmitting components, which temperature differences cause serious alternating thermal loads of these components, and can thus significantly shorten the service life of such components. In such designs, a limited temperature difference, which is matched to the permissible load of these components, and thus a corresponding limitation of the achievable thermal efficiency has to be accepted.

SUMMARY OF THE INVENTION

It is thus the object of the invention to create a hot-gas engine of the type mentioned in the introduction, which engine is in particular further developed and improved in this respect, in which engine the above-mentioned disadvantages do not occur.

Essentially, the advantages of the invention comprise a simplified heat supply, which is improved in comparison to existing designs, to the working medium contained in the cylinder, and in direct cooling of the working medium in the cylinder, with such direct cooling being obtained by injecting a liquefied working medium, as well as in improved thermal efficiency which can be achieved in this way. The embodiment according to the invention also makes it possible to achieve a simpler, compact and economical design of the hot-gas engine, as well as significantly more efficient operation of this engine.

The embodiments of the invention are stated in the dependent claims.

The invention is explained with reference to diagrammatic embodiments shown in the enclosed drawings.

DESCRIPTION OF THE PREFERRED EMBODIMENT

Figure 1:
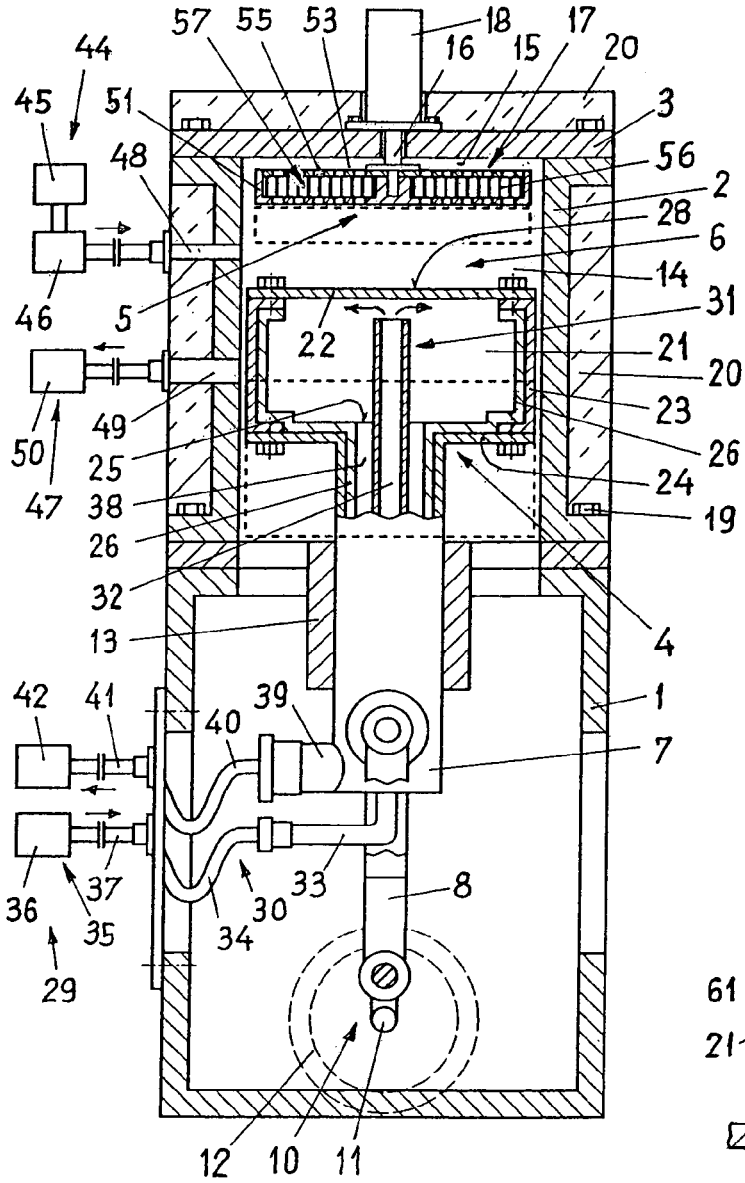
FIG. 1 is a longitudinal section of a first embodiment of a hot-gas engine according to the invention.

FIG. 1 shows a Stirling cycle hot-gas engine which comprises a housing 1, a cylinder 2 with a cylinder cover 3, a working piston 4 which is slidably arranged in said cylinder 2, and a displacement device 5 which is arranged between said working piston 4 and the cylinder cover 3. The working piston 4, which together with the cylinder cover 3 delimits a cylinder space 6 which is designed to accommodate any desired working medium e.g. air, helium or the like, can be coupled to a drive arrangement by way of a hollow piston rod 7 and a connecting rod 8 linked to said piston rod 7, with said drive arrangement comprising a crankshaft 11, held in the housing 1, and a flywheel 12. The crankshaft can be coupled to any desired machine, e.g. to a generator (not shown). The piston rod 7 is guided in a crosshead 13 connected to the housing 1 so as to be axially slidable. The cylinder 2 is connected to the housing 1 and to the cylinder cover 3 by means of screws 19. The cylinder 2 and/or the cylinder cover 3 can each comprise a heat-insulating insulation layer 20, as shown in the drawing.

The displacement device 5, which divides the cylinder space 6 into a first working space 14, facing the working piston 4, and into a second working space 15 which faces the cylinder cover 3, comprises a displacement piston 17 which, by way of a second piston rod 16 guided in the cylinder cover 3, is slidably coupled in relation to the working piston 4 to a drive device 18 which can be independently controlled and which is arranged on the cylinder cover 3. The drive device 18 can comprise an electrically driven motor or, as is the case in the example shown, a pneumatically driven motor which can be influenced by way of control means (not shown) which are known per se, e.g. by means of control signals which are derived from a particular angular position of the crankshaft 11.

The working piston 4 is a hollow body comprising a hollow space 21 which is delimited by an end wall 22 which faces the first working space 14, a circumferential wall 23, and a bottom section 24 which is connected to the hollow piston rod 7, wherein at least the end wall 22 comprises a material which has good thermal conductivity, e.g. an aluminium alloy. The end wall 22 and the bottom section 24 can be plates that are resistant to bending, as shown in the drawing, with said plates being screwed to a ring of U-shaped cross-section, which ring forms the circumferential wall 23.

The bottom section 24 contains a passage 25, which is open towards the hollow piston rod 7, for a line organ 32, which supplies a fluid operating medium, in the form of an interior tube which passes through the piston rod 7 in longitudinal direction, with said interior tube with the wall of the piston rod 7 delimiting a connection channel 38, which is open towards the hollow space 21, for leading away the operating medium. By way of a first connection section 33, which passes through the wall of the piston rod 7, and a line arrangement 30, which contains a movable line section 34, the line organ 32 can be coupled to a stationary connection organ for the operating medium. By way of a second connection section 39 provided in the wall of the piston rod 7, and by way of a movable line section 40, the connection channel 38 can be coupled to a stationary connection organ for the operating medium which is to be led away. The circumferential wall 23, the bottom section 24 and the piston rod 7 can each be lined with at least one layer 26 of a heat insulating material, e.g. glass wool or the like. The line organ 32, which can comprise corresponding heat-insulating external insulation, is designed as an element of a heating device 31 for heating up the working medium situated in the first working space 14.

The heating device 31 comprises a heating organ on the working piston 4, with a heating surface 28 directed towards the first working space 14, and a heating arrangement 29 for said heating organ. The heating surface 28 is located on the end wall 22 of the working piston 4, which end wall 22 is a heating organ. The heating arrangement 29 comprises a stationary feed unit 35, associated with the hollow space 21 of the working piston 4, comprising a feed line 37, which is connected to a heat source 36, for a fluid heat transmission agent. For example, a burner, whose product of combustion serves as a heat transmission agent, can be provided as a heat source. The feed line 37 can be coupled to the line organ 32 by way of the line arrangement 30, with said line organ 32 ensuring safe supply of the heat transmission agent into the hollow space 21. In this process, by way of the heated end wall 22, heat is continually emitted to the working medium contained in the first working space 14. The heat transmission agent cooled down in the hollow space 21 is led away by way of the connection channel 38 and can be emitted to the environment by way of an outlet line 41 which can be coupled to the line section 40, or, as shown in the drawing, it can be emitted to a collector 42 which is located in the feed unit 35. The line sections 34 and 40 can each comprise a flexible metal hose, as shown in the drawing.

A cooling device 44, associated with the first working space 14, is provided for cooling the heated working medium, which cooling is required for operating the hot-gas engine. Said cooling device 44 comprises an injection device 46, which can be connected to a storage unit 45 for liquefied working medium and which is independently controllable, for feeding a defined quantity of liquefied working medium, which is used as a coolant, into the first working space 14, and an outlet arrangement 47 for leading away an excess quantity, which arises during the injection procedure, of the working medium from the first working space 14. As is the case in the embodiment described, the working medium used in the working process can serve as a coolant. Alternatively, according to another possible embodiment, a second working medium of the same type can be used as a coolant.

The injection device 46 comprises an injection organ 48 which passes through the cylinder wall, with said injection organ 48 leading into the first working space 14 between the shown upper dead centre of the working piston 4 and the lower dead centre (shown in a dashed line in the drawing) of the displacement piston 17. Furthermore, the injection device 46 is connected to a control device (not shown) which can be influenced by way of control means which are known per se, e.g. by control signals that are derived from a defined angular position of the crankshaft 11, in the sense of clocked operation of the injection device 46. The outlet arrangement 47 comprises an outgoing line 49, which passes through the cylinder wall, which outgoing line 49, above the lower dead centre position (shown in a dashed line in the drawing) of the working piston 4, is connected to the first working space 14. The outgoing line 49 can lead to the outside environment or, as shown, it can be connected to a collector 50 for excess working medium. Furthermore, embodiments are possible where two or several injection lines 48 and/or outgoing lines 49 are provided which in circumferential direction are offset in relation to each other.

The displacement piston 17 is a hollow body which comprises a dish-shaped lower part 51 and a cover plate 53. The cover plate 53 is held on a central shoulder, which projects from the lower part 51, by an end section of the second piston rod 16, which end section can be screwed to said central shoulder. The lower part 51 and the cover plate 53 each comprise several passage apertures 55 for the working medium. Arranged in the lower part 51 is an insert 56 made of a regeneratively heat-storing material, through which insert 56 the working medium can flow.

The insert 56 can be a loose coil, comprising several windings, of ribbon-shaped wire mesh or, as is the case in the embodiment shown, a lose package of respective concentrically arranged ring-shaped ribbon sections which extends over the entire lower part 51. The insert 56 thus forms a continuous regenerator 57 which is integrated in the displacement piston 17. Said regenerator 57 withdraws heat from the heated working medium when it passes from the first working space 14 to the second working space 15, and resupplies this heat to the working medium when it flows back into the first working space 14. The regenerator 57 essentially extends across the entire cross section of the cylinder space 6 so that a correspondingly large storage capacity can be achieved.

In the above-described Stirling cycle hot-gas engine, the heat which is supplied to the working piston 4 from the outside is continually given off within the engine to the working medium contained in the first working space. The cooling of the working medium which is always in a heated state, which cooling is required during the compression phase of the work process, is ensured by the injection device 46 that is associated with the first working space 14. The heat required during the expansion phase is continually fed to the working medium by way of the working piston 4. The heat, which is isochorically exchanged in the engine, is emitted to the working medium at the end of the compression phase by way of displacement and is taken over at the end of the expansion phase. The working piston 4 can be made with or without sealing material.

The design described above provides a number of advantages. The heating area 28 at the end wall 22 of the working piston 4 makes possible heat transfer that is effective across the entire cross-section of the cylinder and that is thus particularly efficient. This heat transfer is further enhanced by the movement of the working piston 4 and by turbulence in the working medium. As a result of the injection device 46, correspondingly advantageous cooling of the working medium can be achieved, which cooling at least in the first working space 14 is directly effective and is thus particularly efficient, with said cooling, too, being further enhanced by the movement of the working piston 4 and by turbulence in the working medium. During the injection of a liquefied gas, which evaporates in the working space 14 and which thus at the same time acts as a working medium, the working medium is cooled down very considerably wherein negative pressure may be generated at the beginning of the compression phase, which negative pressure enhances the movement of the working piston 4. By evaporating the injected working medium and by constantly heating the entire working medium, a correspondingly increased pressure results at the end of the compression phase, as a result of which the yield of the heat supplied to the engine can be further improved. At the end of the expansion procedure, the excess quantity of working medium corresponding to the pressure which is present in the engine at the beginning of compression is led away. The embodiment described, in particular when combined with the regenerator 57 which extends across the entire cylinder cross-section, which regenerator is located in the displacement piston 17, makes possible an advantageously simple and compact design of the hot-gas engine.

Incidentally, the mode of operation of a hot-gas engine is generally known to the average person skilled in the art (e.g. from DE 25 22 711 A1) so that there is no need to provide more detailed information in this respect.

Figure 2:
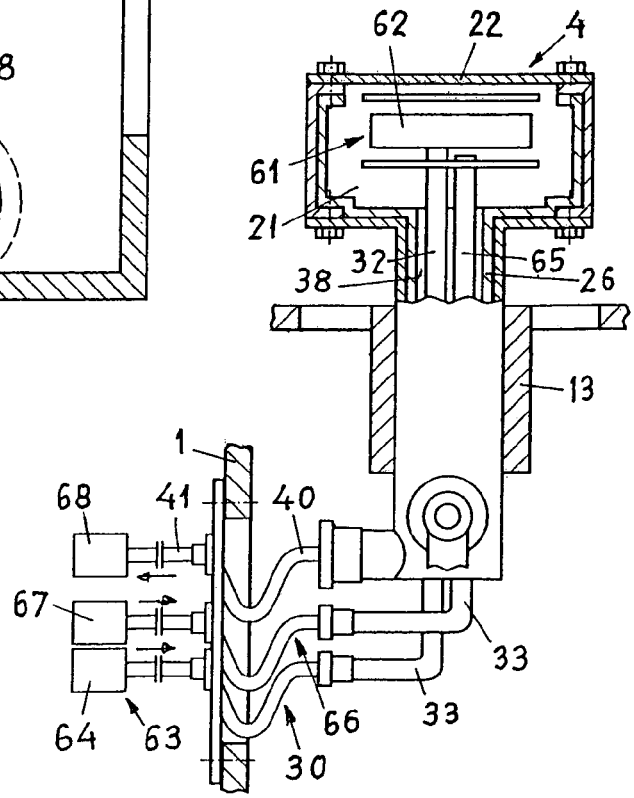
FIG. 2 is a second embodiment showing details of a hot-gas engine according to FIG. 1.

In the figures of the drawing, corresponding components are designated by the same reference characters. FIG. 2 shows parts of the embodiment according to FIG. 1 and a modified heating device 61 with a catalytic heating unit 62, arranged in the hollow space 21 of the working piston 4, which heating unit 62 can be connected, by way of the line organ 32 and the line arrangement 30, to a source 64 of a fuel, e.g. hydrogen, which source 64 is present in a feed unit 63, with said heating unit 62 being connectable, by way of a line organ 65 of an additional line arrangement 66, to a source 67 of a reactant or oxidant present in the feed unit 63. The process products arising during the catalytic process can be emitted to the atmosphere by way of the connection channel 38 which encloses the line organs 32 and 65, and by way of the outlet line 41. Alternatively, said process products can be fed to a collector 68, as shown in the drawing.

In the embodiment according to FIG. 2, the heat to be transmitted to the working medium is generated within the engine, in close proximity to the end wall 22 to be heated up. With the heating device 61, which can be controlled in a relatively simple way, particularly efficient heat transmission can be achieved. Numerous further embodiments (not shown) with correspondingly simple controllable heating devices are also possible. Thus, an electrical heating element which can be connected to a stationary electricity source, or a heating unit comprising a nuclear heat source, which heating unit can be connected to a stationary control device, can be provided in the hollow space 21 of the working piston 4.

Figure 3:
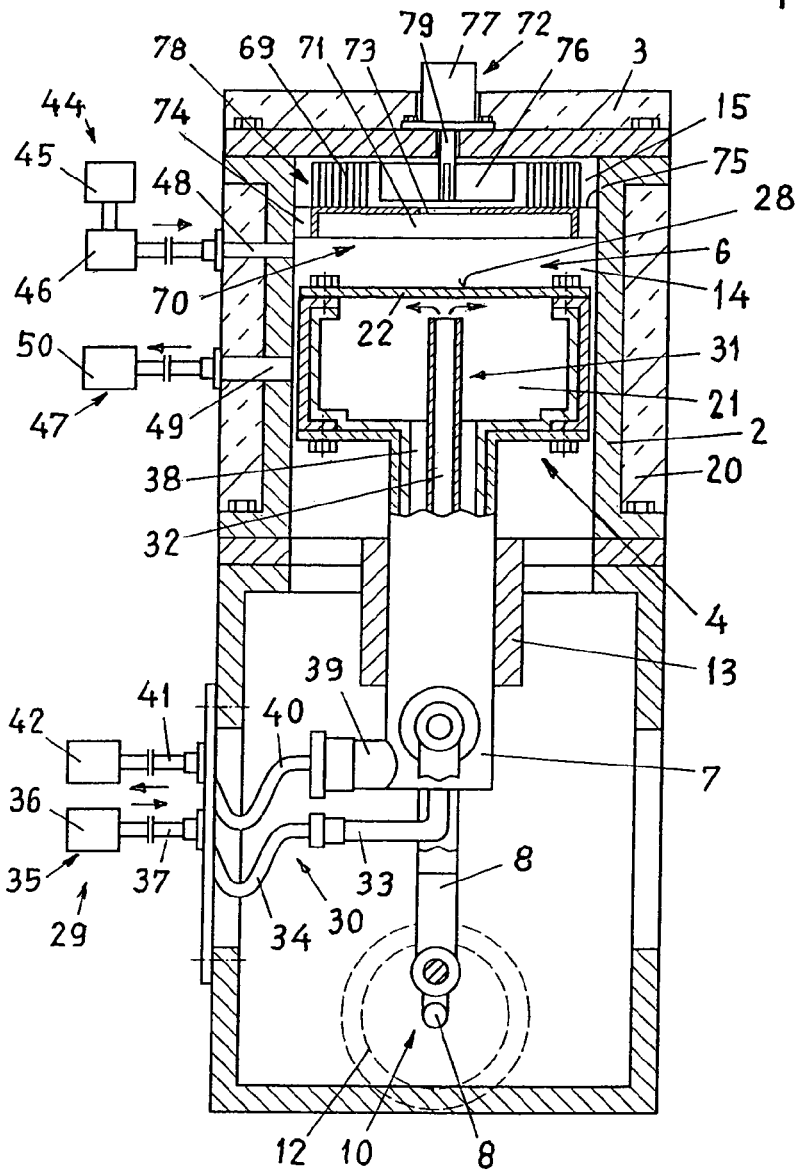
FIG. 3 is a longitudinal section of a third embodiment of a hot-gas engine according to the invention.

FIG. 3 shows a hot-gas engine which differs from the embodiment according to FIG. 1 only by a modified displacement device 70. The following description is thus essentially limited to outlining the respective differences. The displacement device 70 comprises a dish-shaped conduction element 71, arranged in a stationary manner in the cylinder space 6, and a dynamic conveying device 72 which is used for displacing the working medium from the first working space 14 to the second working space 15, and for returning the displaced working medium to the first working space 14. The conduction element 71 comprises a central passage aperture 73 which interconnects the working spaces 14 and 15; said conduction element 71 further comprises a circumferential section which projects in the direction of the first working space 14, wherein said circumferential section together with the cylinder wall delimits a ring-shaped peripheral passage aperture 75 for the working medium, with said peripheral passage aperture 75 interconnecting the working spaces 14 and 15. The conveying device 72 comprises a fan, arranged in the second working space 15 (according to the drawing this is a radial fan 76 whose flow passes through the central passage aperture 73), with said fan being coupled by way of a shaft 79 to a drive unit 77 arranged on the cylinder cover 3.

As is the case in the present embodiment, the drive unit 77 can comprise an electric motor. The conduction element 71 can be attached to the cylinder 2 by way of a number, e.g. three, of holding elements which are arranged so as to be distributed around its circumference. Locking screws or, as shown in the drawing, ribs 74 which project from the conduction element 71 can be provided as holding elements, wherein said ribs 74 are held in any desired way (not shown) to the cylinder wall. The conduction element 71 can also be connected to the cylinder cover 3 to form an installation unit by way of any desired holding means (not shown).

A regenerator 78, which surrounds the fan 76 in a ring-shaped manner, is arranged in the second working space 15. The regenerator 78 comprises: a heat-storing package 69, arranged on the conduction element 71, through which package 69 the working medium flows in a radial direction, wherein said package 69, like the insert 56 in the embodiment according to FIG. 1, can be composed of ribbon-shaped sections of wire mesh or the like, which wire mesh sections are arranged so as to be upright.

During operation of the hot-gas engine, the fan 76 is on continuously. In permanent circulation, the working medium, which is continuously being heated in the first working space 14, is sucked through the central passage aperture 73 into the second working space 15, and is conveyed back to the first working space 14 through the peripheral passage aperture 75.

During the compression phase, the required cooling of the working medium is achieved by injection of the liquefied working medium. In this way, first the entire working medium contained in the cylinder 2 and also the regenerator 78 are cooled down, and subsequently heated up, wherein the pressure in the cylinder 2 is increased almost isothermally. During the expansion phase, the heat conveyed from the outside is emitted to the working medium and to the regenerator 78, as a result of which, work is generated and the pressure in the cylinder 2 is decreased almost isothermally. At the end of the expansion phase, the excess quantity of the working medium corresponding to the pressure present in the engine at the beginning of compression is led away. The drive unit 77 of the fan 76 can be operated independently of the drive arrangement 10 of the hot-gas motor; consequently said drive unit 77 can be of a simple design, without comprising any particular control means. The stationary displacement device 70 and the regenerator 78 can be designed with relatively small dimensions; a feature which makes it possible to design the hot-gas engine such that it is of particularly compact and simple construction.

Figure 4:
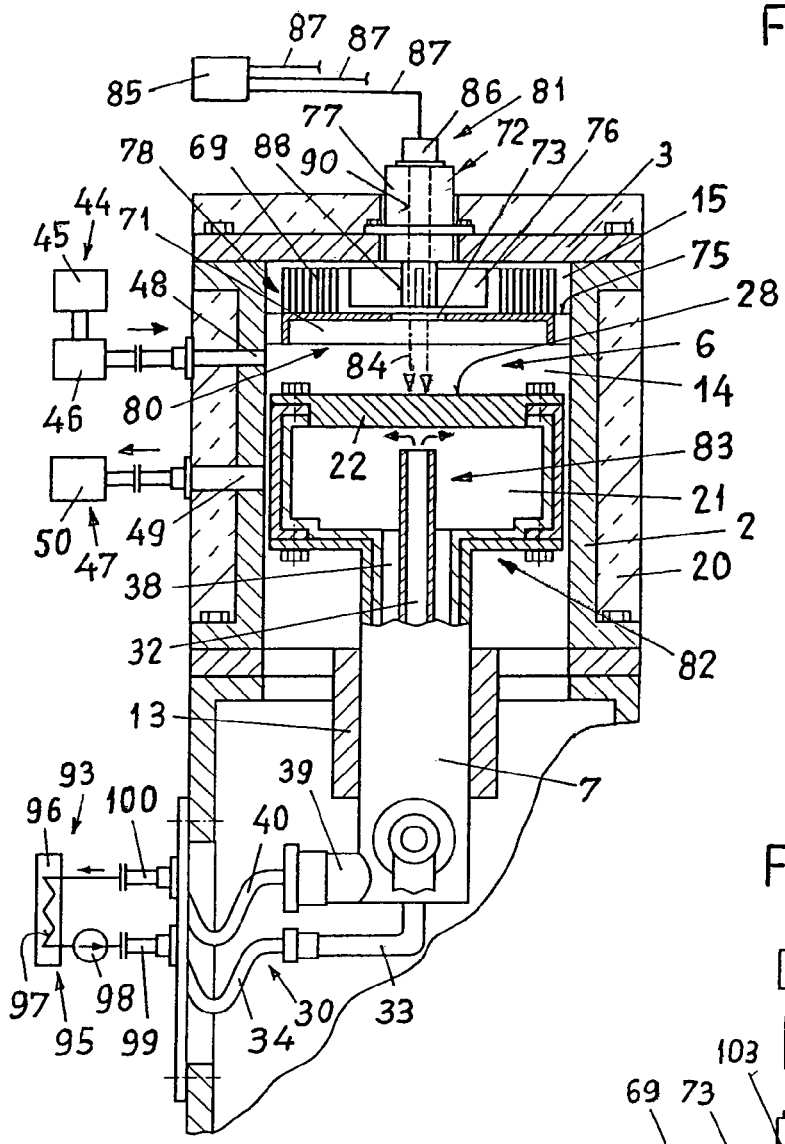
FIG. 4 is a fourth embodiment of a hot-gas engine according to FIG. 3, in partial view.

FIG. 4 shows parts of a hot-gas engine, wherein this embodiment of said engine differs from the embodiment according to FIG. 3 by a modified heating device 81 for heating the working medium contained in the first working space 14, and a modified displacement device 80, as well as by a modified working piston 82 and an auxiliary device 83, which is associated with said modified working piston 82, which auxiliary device 83 can be connected temporarily or permanently. The following description is essentially limited to explaining the corresponding differences. The heating device 81 comprises a solar collector plant 85, designed for emitting bundled solar radiation 84, wherein said solar collector plant 85 comprises at least one connection organ 86, associated with the cylinder cover 3, which connection organ 86 is designed to introduce at least part of the bundled solar radiation 84 into the first working space 14. As shown in the drawing, said connection organ 86 is arranged on the drive unit 77 of the displacement device 80. The connection organ 86 can be connected to an outlet of the solar collector plant 85 by way of a supply line 87 which can comprise a bundle of light-conducting fibres. Said connection organ 86 comprises a tubular line element 90, designed for insertion into the cylinder 2, for conveying solar radiation 84.

The fan 76 of the displacement device 80 can be coupled to the drive unit 77 by way of a straight-through hollow shaft 88 which at the same time is designed for non-contact accommodation of the line element 90, thus surrounding an exit for solar radiation 84, which exit is directed towards the first working space 14. The line element 90 can comprise a closure part (not shown), made from a transparent material, e.g. glass or the like, which closure part is impermeable to the working medium. The closure part can also be a refractive optical element, e.g. a dispersing lens or the like.

The arrangement described makes it possible for the bundled solar radiation 84 to be inserted, in an unhindered way without significant heating up of the conveying device 72 and of the working medium contained in the second working space 15, through the central passage aperture 73 into the first working space 14, and to be concentrated on a central section of the working piston 82 whose end wall 22 is located on a relatively solid head section which is made of a heat-absorbent material with good thermal conductivity, for example a ceramic material suitable for high thermal loads. Accordingly, the stored heat can be evenly distributed over the end wall 22 in an advantageously efficient and simple way and can be emitted to the working medium contained in the first working space 14.

The solar collector plant 85 can comprise a focusing system, known per se, made of concentrating reflectors (not shown) as is assumed in the present embodiment. Furthermore, the solar collector plant 85 can comprise at least one additional output, in the embodiment shown two additional outputs, with supply lines 87 which can be connected to said outputs, wherein each of said supply lines 87 can be associated with a corresponding connection organ 86 of a further hot-gas engine (not shown).

The auxiliary device 83, which is associated with the working piston 82, comprises a stationary heat exchange system 93, which can be connected to a source of any desired fluid heat transmission agent, for cooling and/or additional heating of the end wall 22. The heat exchange system 93 comprises a heat storage unit 95 with a storage container 96 which is designed to hold any desirable storage medium, wherein said storage container can comprise thermal insulation. The storage container 96 comprises a heat transmitting device 97, which in the drawing shown is a heating/cooling coil, whose exit is connected to the line organ 32 by way of a pump 98 and a supply line 99 for the heat transmission agent, and whose inlet is connected to an outlet line 100, connected to the connection channel 38, for the heat transmission agent. It is thus possible for the heat transmission agent to flow in a closed loop through the heat transmitting device 97 and the hollow space 21. Depending on the operating phase, heat can either be removed from, or supplied to, the end wall 22. In the storage container 96, heat can be removed from the heat transmission agent heated up in the hollow space 21, or heat can be supplied to the heat transmission agent cooled down in the hollow space, after which the heat transmission agent is again conveyed back to the hollow space 21. The heat transmission agent and/or the storage medium can for example be oil, liquid sodium, or, as has been assumed in the present example, water. The auxiliary device 83, to which control and/or regulation means (not shown), which are known per se, can be associated, is designed to ensure any necessary cooling of the end wall 22, which is heated by solar energy, to a specified operating temperature, and/or heating of the end wall 22, which heating is adequate for operating the engine in the case of insufficient or non-existent solar radiation.

Figure 5:
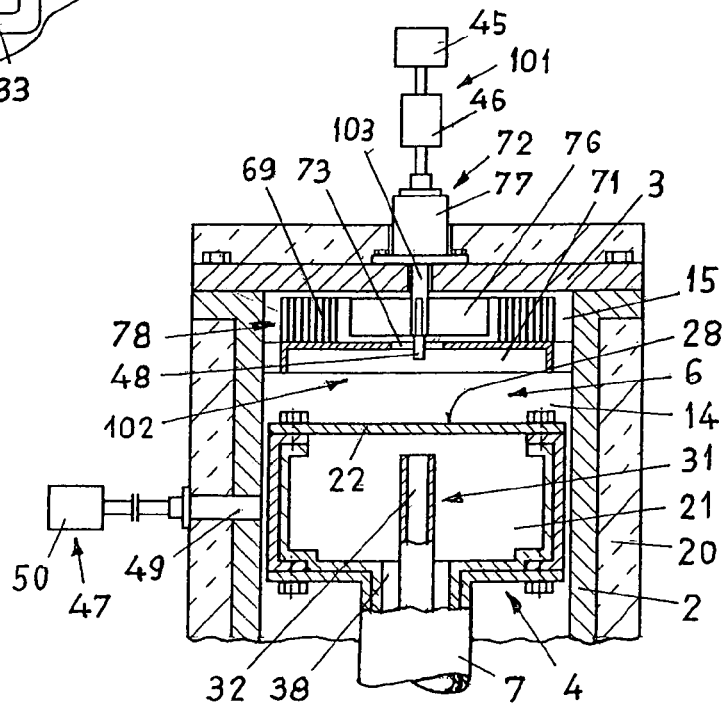
FIG. 5 is a fifth embodiment of a hot-gas engine according to FIG. 3, in partial view.

FIG. 5 shows parts of a hot-gas engine, wherein the embodiment of said engine differs from the embodiment according to FIG. 3 only by a modified cooling device 101 and a modified displacement device 102. The following description is thus limited to explaining the respective differences. The injection device 46 of the cooling device 101 is located on the drive unit 77. The fan 76 of the displacement device 102 can be coupled to the drive unit 77 by way of a straight-through hollow shaft 103 which at the same time is designed for non-contact accommodation of a section of the injection line 48, which section passes coaxially through the hollow shaft 103, wherein said section extends through the central passage aperture 73 of the conduction element 71 into the first working space 14. Accordingly, only one passage for the outlet arrangement 47 has been provided in the cylinder wall. In this embodiment, the liquefied working medium which is used as a coolant is injected into a central region of the first working space 14. As a result of this, the working medium, which evaporates during this process, can be evenly distributed across the cylinder cross-section, and the working medium contained in the cylinder 2 can accordingly be cooled evenly.

Figure 6:
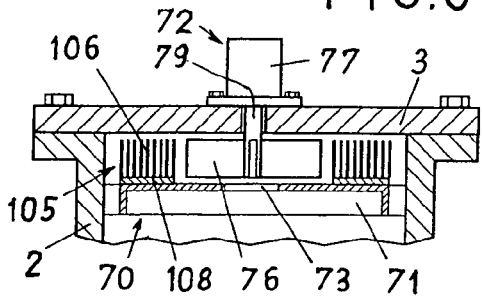
FIGS. 6–9 are details of a hot-gas engine according to FIG. 3, each in a modified embodiment.
Figure 7:
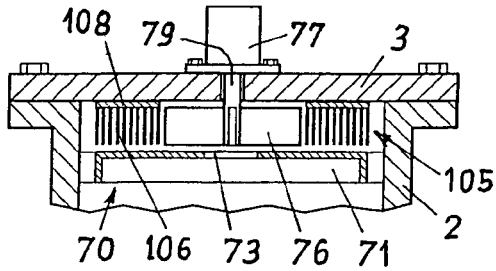
Figure 8:
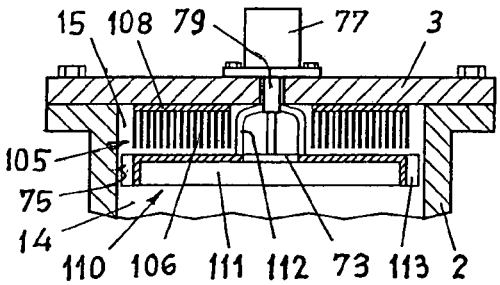

FIGS. 6, 7 and 8 show arrangements of a brushless regenerator 105, modified when compared to the embodiments according to FIGS. 3, 4 and 5. Said regenerator 105 comprises a heat-storing package 106 comprising a multitude of pin-shaped storage elements arranged side by side, wherein the working medium can radially flow through said package 106, with said pin-shaped storage elements being attached to a circular holding device 108 so that they are free-standing. As shown in the drawing, wire sections can be provided as storage elements. The holding device 108 can comprise individual plate segments or, as has been assumed in the embodiments shown, it can be designed in one piece. The holding device 108 can be arranged on the conduction element 71, as shown in FIG. 6, or it can be arranged on the cylinder cover 3, as shown in FIGS. 7 and 8.

FIG. 8 also shows a modified displacement device 110 comprising a conduction element 111 which is rotatably arranged at some distance from the cylinder wall, wherein said conduction element 111 at the same time forms the rotor of an axial fan. The conduction element 111, which at its circumference comprises blades 113, can be coupled to the drive unit 77 by way of a central connection section 112 which is of cage-like shape. In this embodiment, the working medium, which has been heated up in the first working space 14, can be sucked through the peripheral passage aperture 75 into the second working space 15, and can be conveyed back through the central passage aperture 73 into the first working space 14. Depending on the embodiment of the blade arrangement 113, the working medium can also be sucked in through the central passage aperture 73 and conveyed back through the peripheral passage aperture 75.

Figure 9:
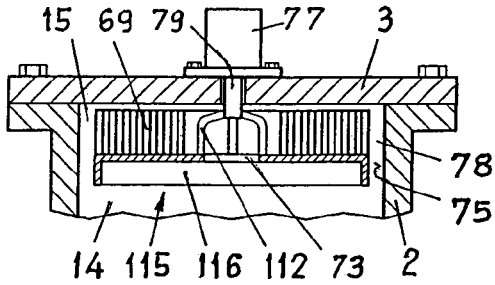

FIG. 9 shows a further modified displacement device 115 comprising a conduction element 116 which is rotatably arranged at some distance from the cylinder wall, wherein said conduction element 116 with the regenerator 78, through which air can flow radially, forms a rotor, which can be coupled to the drive unit 77 of a fan arrangement through which air is supplied through the central passage aperture 73.

Figure 10:
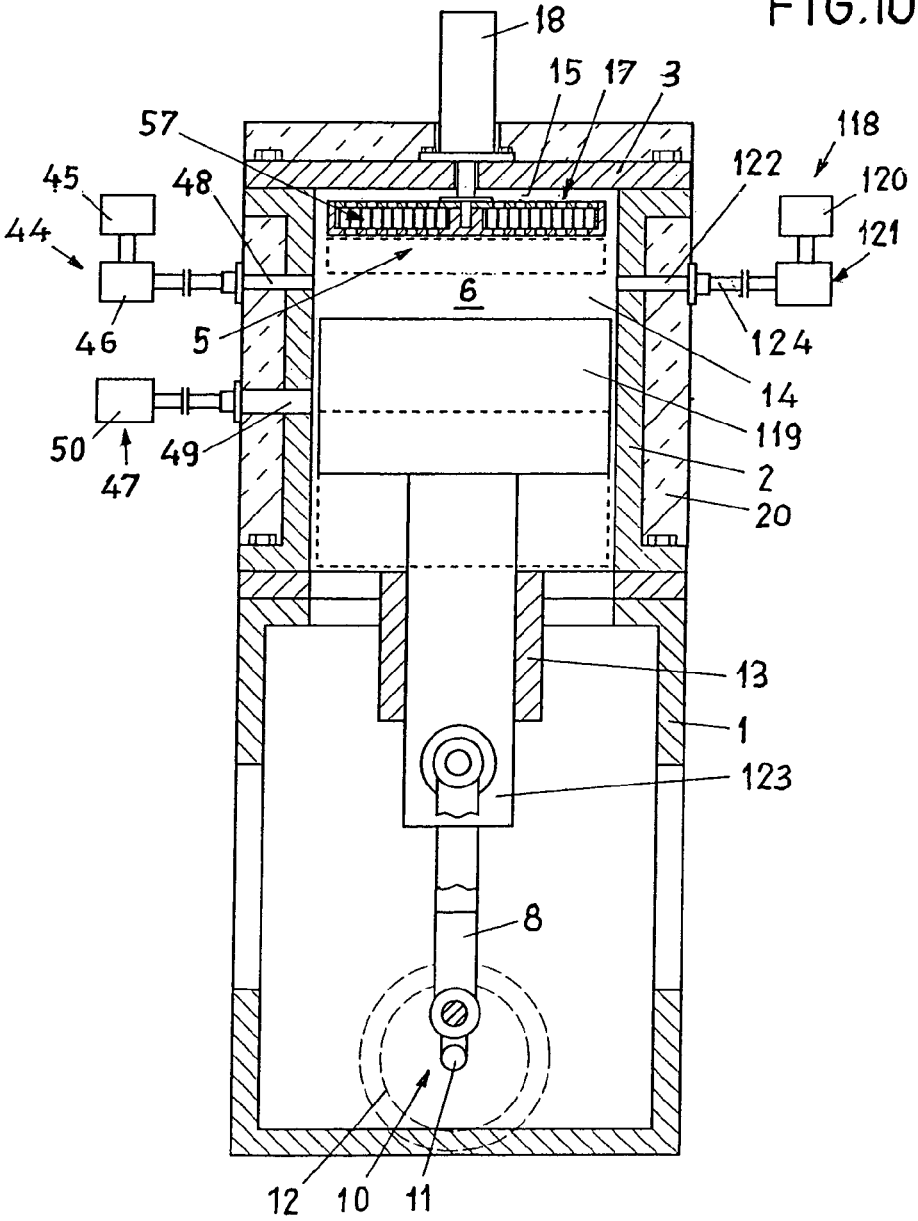
FIG. 10 is a longitudinal section of a sixth embodiment of a hot-gas engine according to the invention.

FIG. 10 shows an embodiment of a hot-gas engine, which differs from the embodiment according to FIG. 1 by a modified heating device 118 for heating up the working medium contained in the first working space 14, and furthermore differs by a modified working piston 119. The following description only deals with the differences. The heating device 118 contains an injection arrangement 121, which can be controlled independently, and which can be connected to a source 120 of any desired fluid hot heating agent, wherein said injection arrangement 121 is designed for introducing the hot heating agent into the first working space 14. In the embodiment shown, the heating agent is supercritically hot steam.

The injection device 121 comprises at least one injection organ 122, which passes through the cylinder wall and which is a heating organ, wherein said injection organ 122 is connected to a supply line 124 for the heating agent and above the upper dead centre of the working piston 119 leads into the first working space 14. The injection arrangement 121 is connected to a control device (not shown) which can be influenced by way of control means which are known per se, e.g. by means of control signals which are derived from a particular angular position of the crankshaft 11, e.g. shortly before or after the end of the compression phase, in the sense of clocked injection of the heating agent. At the end of the expansion process, the heating agent, which is cooled during injection, together with the excess quantity of working medium, is let out through the outlet arrangement 47. The working piston 119, which is not heated in this embodiment, can be designed in any conventional way, and can be coupled to the drive arrangement 10 by way of a piston rod 123, which is of correspondingly simple design.

The embodiment described makes possible an advantageously simple and compact design of the hot-gas engine, as well as directly effective and thus particularly efficient heat transfer to the working medium, wherein said heat transfer can be influenced with relatively low control expenditure. A corresponding injection arrangement 121 can also be provided in any of the embodiments described above, with a heatable working piston 4 or 82, e.g. as an additional heating device which can be connected optionally or permanently.

The invention claimed is:

1. A hot-gas engine comprising at least one cylinder and a working piston moving to and fro which together with a cylinder cover delimits a cylinder space designed to accommodate a working medium, comprising a displacement device which divides the cylinder space into a first and a second working space, comprising a heating device for heating up the working medium contained in the first working space, and comprising a cooling device for cooling the heated working medium, wherein the working spaces are connected so as to be communicating by way of a regenerator, wherein the first working space is arranged between the working piston and the displacement device, in that the heating device comprises at least one heating organ that faces in the direction of the first working space, and the cooling device comprises an injection device for feeding a liquefied working medium, which is used as a coolant, into the first working space and an outlet arrangement for leading away the excess working medium from the first working space.

2. The engine according to claim 1, wherein the displacement device comprises a displacement piston which can be slid to and fro relative to the working piston, wherein the regenerator is arranged in the displacement piston.

3. The engine according to claim 1, wherein the displacement device comprises a stationary conduction element which essentially extends across the cross-section of the cylinder space, and a dynamic conveying device for displacing the working medium from the first working space to the second working space, and for returning the displaced working medium to the first working space, and in that the regenerator is arranged in the second working space.

4. The engine according to claim 3, wherein the conduction element comprises at least one central passage aperture, which interconnects the working spaces, and said conduction element delimits at least one peripheral passage aperture for the working medium, which peripheral passage apertures is provided in the circumferential region of said conduction element.

5. The engine according to claim 3 or 4, wherein the conveying device comprises a fan, arranged in the second working space, with said fan being able to be coupled to a drive unit arranged on the cylinder cover.

6. The engine according to claim 3 or 4, wherein the conduction element is designed as the rotor of a fan arrangement and can be coupled to a drive unit of the conveying device which drive unit is arranged on the cylinder cover.

7. The engine according to claim 1, wherein the injection device comprises at least one injection organ, which above the upper dead centre of the working piston leads into the first working space, and in that the outlet arrangement comprises at least one outgoing line for the coolant, which outgoing line is connected above the lower dead centre of the working piston to the first working space.

8. The engine according to claim 1, wherein the heating device comprises a heating area arranged on the working piston, which heating area faces the first working space, and comprises a heating arrangement associated with the working piston for said heating area.

9. The engine according to claim 8, wherein the working piston comprises a hollow body which is delimited by an end wall which comprises the heating are 28, a circumferential wall, and a bottom section which can be connected to a piston rod, wherein said bottom section comprises a passage for line means which are associated with the hollow space, with said line means being designed for supplying and leading away at least one fluid operating medium, in that at least the end wall comprises a material which has good thermal conductivity, and in that at least the circumferential wall comprises at least one layer made of a heat-insulating material.

10. The engine according to claim 9, wherein the piston rod is hollow, wherein the hollow piston rod is connected to the passage of the bottom section, in that the line means comprise at least one line organ which is arranged within the piston rod and which projects into the hollow space of the working piston, and further comprise a connection channel, provided between said line organ and the wall of the piston rod, with said connection channel being open towards the hollow space, and in that the line organ and the connection channel can each be connected, by way of a line arrangement which comprises a movable line section, to a stationary connection organ for the operating medium.

11. The engine according to claim 10, wherein the hollow piston rod comprises at least one layer made of a heat-insulating material.

12. The engine according to claim 10 or 11, wherein the heating device comprises a feed unit associated with the hollow space for supplying a fluid heat transmission agent, in that the line organ is connected to a feed line which can be coupled to the feed unit, and in that the connection channel is connected to an outlet line for the heat transmission agent.

13. The engine according to claim 10 or 11, wherein the heating device comprises a catalytic heating unit which is arranged in the hollow space of the working piston, wherein said catalytic heating unit is connected to a source of a fluid fuel by way of a first line organ, and is connected to a source of a reactant or oxidant by way of a second line organ, and in that the connection channel is connected to an outlet line for combustion products.

14. The engine according to any one of claims 9 to 11, wherein the heating device comprises at least one connection organ of a solar collector plant, with said connection organ being arranged on the cylinder cover, as well as a conduction element, which can be inserted into the cylinder space, for introducing bundled solar radiation into the first working space, and in that at least one passage aperture for solar radiation is provided in the displacement device such that said solar radiation can be concentrated onto the end wall of the working piston.

15. The engine according to claim 14, wherein the line organ is connected to a supply line for a fluid heat transmission agent, where said supply line is connected to a heat exchange system, and in that the connection channel is connected to an outlet line for heat transmission agent, with said outlet line being connected to the heat exchange system.

16. The engine according to claim 1, wherein the heating device comprises an injection arrangement comprising at least one injection organ for supplying a fluid hot heating agent into the first working space.

* * * * *